United States Patent [19]

Wells et al.

[11] Patent Number: 4,659,292

[45] Date of Patent: Apr. 21, 1987

[54] HYDRAULIC POWER BOOSTER APPARATUS

[75] Inventors: David L. Wells; Allen M. Johnson, both of West Bend, Wis.

[73] Assignees: Dennis J. Lawman, Laurens; Richard E. Altringer, Storm Lake, both of Iowa

[21] Appl. No.: 100,859

[22] Filed: Dec. 6, 1979

Related U.S. Application Data

[63] Continuation of Ser. No. 752,630, Dec. 20, 1976, abandoned.

[51] Int. Cl.[4] ..... F04B 17/00

[52] U.S. Cl. ..... 417/225; 417/403

[58] Field of Search ..... 417/391, 376, 403, 225

[56] References Cited

U.S. PATENT DOCUMENTS

| | | | |
|---|---|---|---|
| 2,424,332 | 7/1947 | Rose | 412/391 |
| 2,652,780 | 4/1953 | Adams | 417/225 |
| 2,708,412 | 5/1955 | Mueller | 417/225 |
| 2,787,223 | 4/1957 | Sargent | 417/391 |
| 2,826,149 | 3/1958 | Wrigley | 417/225 |
| 3,333,425 | 8/1967 | Hemard | 417/225 |
| 3,440,967 | 4/1969 | Pennther | 417/391 |
| 3,775,028 | 11/1973 | Davis | 412/391 X |

*Primary Examiner*—Carlton R. Croyle

*Assistant Examiner*—T. Olds

*Attorney, Agent, or Firm*—Andrus, Sceales, Starke & Sawall

[57] ABSTRACT

A hydraulic actuated pressure booster unit includes a differential power piston and an integral control valve controlling the pumping direction and action. The control valve has a reciprocally mounted tubular spool member in a cylinder valve body. The spool member has a control passageway and a plurality of spaced spools, one of which mates with the power piston passage to form a first valve for transfer of oil to the pumping chamber and from a transfer chamber to an exhaust passageway. A pair of spaced spools slide in stepped control chamber forming a control bore and exhaust bore connected by the spool passageway to the pumping chamber via the first valve. A sequence valve connects the exhaust bore to the exhaust through a directional control valve. The sequence valve is controlled by the output working pressure. A pilot valve controls the load connection to the one end of the cylinder and a high pressure relief valve limits the total pressure created within the working system. The valves and operating sections are axially mounted in longitudinal spacing within a tubular housing having fluid passages formed by recesses in the sidewalls and sealed by an outer shell.

5 Claims, 11 Drawing Figures

HYDRAULIC POWER BOOSTER APPARATUS

This is a continuation application of application Ser. No. 752,630, filed Dec. 20, 1976, now abandoned.

BACKGROUND OF THE INVENTION

The present invention relates to the hydraulic actuated apparatus including a hydraulically actuated reciprocating element and particularly to a hydraulic pressure booster having a unique associated control valve means to control the developing of the mechanical motion and the development of high hydraulic pressures where required.

Hydraulic operating and control systems are widely employed in industry. Although they have many advantages, the development of relatively high working pressures from a low pressure input generally require special apparatus which are generally identified as a booster or intensifier. Various such pressure boosters or intensifiers have been suggested wherein in a relatively large quantity of low pressure fluid acts over a relatively large area piston and developes a mechanical force upon a piston of small area which produces a relatively high pressure output. The pressure multipliation is in direct ratio to the piston areas. The prior art hydraulic boosters have employed various controls to create the desired high pressure output, including different electrical, mechanical and hydraulic control systems. A simple hydraulically actuated control is, of course highly desirable. Such control should be adapted to conventional and inexpensive manufacturing and operate directly from the low pressure source to avoid the necessity for separate mechanical and electrical actuating devices. Racine Hydraulics and Machinery of Racine, Wis., U.S.A., for example, uses a hydraulically shifted booster in which a spool valve is connected to a suitable lever which in turn activates a pilot valve to shift a separate four way valve coupling in which the relatively low pressure oil acts over a relatively large piston and moves a relatively small piston and thereby forces oil out under high pressure. The pressure increase is directly proportional and the volume inversely proportional to the differences of the piston areas. The control may be and is generally connected by external flow lines to a pressure sensitive valve unit to permit normal low pressure operation of the load until such time as the load builds to a higher pressure and then automatically shfts to the booster output.

Although pressure booster devices are available and have been relatively widely employed in the industry, there is a need for reliable, in-line intensifying apparatus which can be constructed with commercial production techniques and at low cost. Further, an intensifier unit having integrated hydraulic components and internal passageways to eliminate the usual external flow lines, fittings and the like would avoid serious practical problems in usage and permit an especially desirable construction.

SUMMARY OF THE PRESENT INVENTION

The present invention is particularly directed to a hydraulic actuated apparatus employing a reciprocating means and operable to produce a reciprocation of an element with pressure amplification if desired, as a result of an integral control means controlling the hydraulic supply to the reciprocating means. The reciprocative means may be employed to develop a high pressure output from a low pressure source. Generally, in accordance with the present invention, the control valve means includes a hydraulically actuated valve means for operative delivering of the low pressure fluid to the opposite sides of a reciprocating means in combination with a hydraulically shifted valve means for automatically resetting of the hydraulic flow and initiating recycling of the reciprocating means. The reciprocating means may form part of a hydraulic booster section. The present invention thus is directed to a new and improved control valve apparatus which is particularly adapted to practical production and is readily serviced and repaired. The control valve may be conveniently integrated with the several hydraulic components necessary or desirable to form a booster assembly into a cylindrical elongated unit having internal connecting passageways. This would eliminate the usual interconnecting oil lines and fittings as well as extra mounting brackets for the individual components. This, of course, significantly reduces the weight of the assembly and provides a rugged, lightweight valve apparatus.

In a preferred embodiment of the present invention, a multiple diametered spool member is reciprocally mounted in-line between a control valve body and a reciprocating piston unit. Each spool functions as piston member for conjointly controlling and moving of the spool member during a portion of the complete cycle and also functioning as a valve control means to control the fluid flow and thereby create automatic reciprocation of the piston unit and of the spool member. The piston unit may include a piston means which is movably mounted on the spool member to form a two-position control valve as the result of coaction with a spool on the spool member. The pressure source is connected to an input chamber to one side of the piston means. The spool member is shiftable between a forward position for the expulsion of oil from the discharge power chamber and a reset or return position for returning the piston means and refilling the power chamber for the next stroke. The spool member further includes a pair of actuating or control spool portions of difference areas connected to respond to the supply or input of the low pressure source and to the exhaust or discharge side to control the shifting of the spool. The spool member in a particular embodiment is a tubular member having a central opening. The spool member oppositely projects from a large area low pressure piston unit into the control valve body with a stepped construction and into the reciprocating piston. The spool member is formed with three operative cross-sectional area spools including a centrally located large diameter member, an intermediate diameter member in said piston and a small diameter member at the innermost end within the control valve body. The valve body has a stepped end recess defining bores in which the large and small diameter spools establish controlled movement of the spool member and flow of fluid to exhaust and to the power chamber and thereby the reciprocating piston.

In a booster pump system, a pilot operated check valve may be responsive to the flow conditions such that under normal low pressure operations the fluid is pumped directly to the working cylinder. When movement of the working cylinder is resisted by the load the sequence valve pilot means responds to the increasing pressure and opens the sequence valve to allow oil to flow through the booster section. The incoming fluid automatically functions to actuate the booster section from any existing positions. The booster assembly is, therefore, self-starting from any position by the action of the incoming fluid pressure on the various pistons and valves which make up the reciprocating elements of the assembly.

More particularly, a preferred and practical implementation of the present invention employed as a pressure booster is formed as an in-line tubular assembly having an outer tubular housing within which the several components are secured. The booster section includes a tubular control or valve body secured in one end and having a stepped recess on the inner end forming a control bore, the inner end of which is connected to an exhaust port means. A cylindrical triple headed spool member having a small area piston or spool reciprocally mounted in the control bore, and large area piston or spool spaced from the small area piston and movable into the outer end of the control bore. The outer end of the spool is formed with an intermediate area piston. The spool has a central longitudinal opening to the base of the control bore for connecting of the outer end of the spool to the exhaust. A power piston unit is reciprocally mounted in the housing with an end recess within which the intermediate area spool is located. An internal check valve axial passageway in the piston unit provides for flow from the transfer chamber into the high pressure power chamber. During this portion of the cycle, the pressure acting on the exposed piston area of the spool closes the exhaust opening and the high pressure piston chamber is supercharged. This drives the assembly outwardly to the opposite or bottom of the stroke. The intermediate area piston enters the valve body with the oil being recycled directly into the main chamber until the small diameter spool uncovers a trigger or exhaust opening. The net effective area of the spool and power piston now forces the assembly to rapidly move to the bottom of the stroke, with the intermediate area spool moving into seating engagement with the valve seat in the large area low pressure piston. The pressure cycle again reverses to establish the pumping action until the large diameter spool moves out of the control bore, causing the intermediate diameter spool to move from the large area low pressure piston and again initiating a new cycle.

The spool valve thus causes the automatic reciprocation of the intensifier.

The pilot check valve apparatus may be a simple spring loaded pressure responsive valve. A high pressure relief valve may be coupled to the pilot operated check valve to limit the total pressure created within the working system. The sequence valve may be an adjustable spring-loaded pressure operated valve unit having the pilot pressure connected to the high pressure output line wuch that when the feed-back pressure increases to preselected level, the sequence valve opens to allow oil to flow through the booster section.

In accordance with a further aspect of this invention, the several control valves and operating sections are mounted within a tubular housing in longitudinal spacing and an outer shell is secured over the housing. The exterior of the housing is recessed between radial ports and the shell to form fluid passage between the several valve and operating sections. The shell may be brazed to the housing to increase the pressure level of the assembly. This provides a highly efficient and practical construction as well as a compact and protected design.

The present invention can be advantageously applied to various hydraulic systems. In use, the load pressure increases until a heavy load is encountered. The sequence valve section instantly senses the change and shifts the booster in low speed, high force application of a sufficient level to overcome the resistance. When the resistance is overcome, the sequence valve section automatically shifts back to the high speed mode to complete the load movement.

Thus, the booster valve of the invention, in conjunction with a pressure responsive valve, is particularly desirable in the application where a variable load is encountered and an inversely variable speed characteristic is tolerable.

Further, as described above, the hydraulic apparatus of this invention provide for automatic reciprocation of the booster device mechanism. Consequently, in the broadest aspects of the present invention, the device could be employed to provide an automatic reciprocating motion or the like.

The present invention thus provides a simple, practical and economically constructed automatic reciprocating device adapted for mechanical and hydraulic actions and particularly adapted for interconnection as a high pressure pump source operating from a relatively low pressure input.

BRIEF DESCRIPTION OF DRAWINGS

The drawings furnished herewith illustrate a preferred construction of the present invention in which the above advantages and features are clearly disclosed as well as others which will be readily understood from the following description.

In the drawings.

DESCRIPTION OF THE ILLUSTRATED EMBODIMENT

Figure 1:
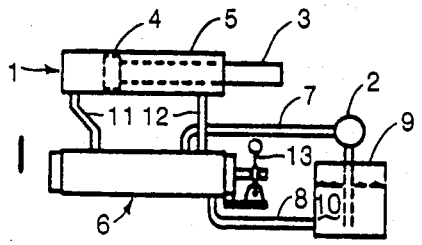
FIG. 1 is a pictorial view of the hydraulically actuated apparatus.
Figure 2:
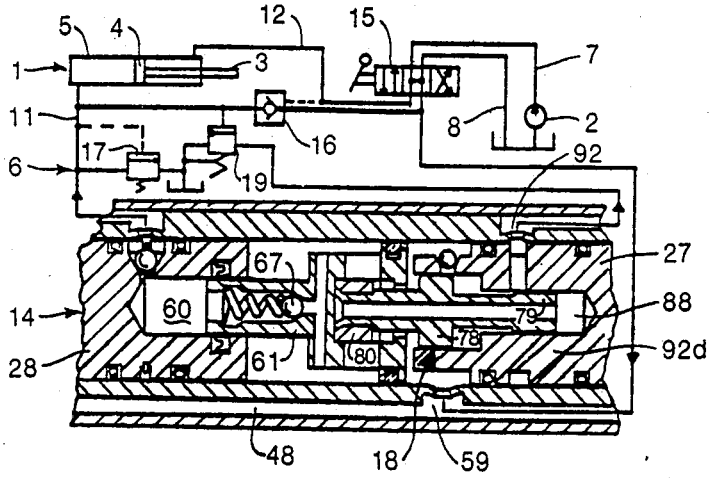
FIG. 2 is a schematic illustration of a hydraulic system as shown in FIG. 1 employing hydraulically actuated apparatus connected to a pressure booster constructed in accordance with the invention.
Figure 5:
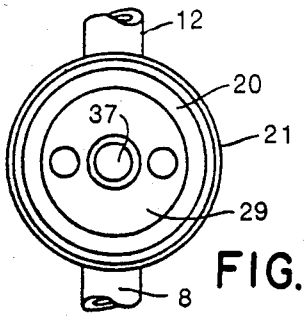
FIG. 5 is an end view of the unit shown in FIG. 3.

Referring to the drawings and particularly to FIG. 1, the present invention is shown connected to operate a working cylinder unit 1 from a low pressure fluid source 2 such as an engine-driven oil or hydraulic pump. The working cylinder unit 1 includes a piston rod 3 connected to a reciprocating piston 4 and passing through a sealed opening in one end of cylinder 5. The engine-driven hydraulic pump 2 is provided and connected to a high pressure booster or intensifier assembly 6 which is constructed in accordance with the teaching of the present invention. The assembly 6 includes an input line 7 connected to pump 2 and a return line 8 connected to a reservoir 9 containing a supply of oil 10. Supply lines 11 and 12 from assembly 6 are connected to the opposite ends of cylinder 5. The assembly 6 operated to selectively supply a low pressure, high volume flow to the working cylinder unit 1 or in the alternative, a low volume, high pressure flow; depending upon the load created on the piston rod 3. A directional control lever 13 is coupled to assembly 6 for controlling the connection of lines 11 and 12 to the outlet of pump 2 for reversing of the piston 4. The cylinder unit 1, the engine driven pump unit 2 and the like are of standard construction and consequently no further description thereof is given. The present invention is particularly directed to the booster assembly 6 and consequently further description of the associated apparatus is given only as necessary to fully disclose the present invention.

Referring particularly to FIGS. 1–4, the illustrated embodiment of the invention is shown as a generally elongated cylindrical assembly 6 having various control valving and operating means mounted in axially spaced relation and interconnected for controlling of a booster pumping means 14 incorporated into the assembly.

Generally, a directional control valve unit 15 is secured in one end of the assembly 6 and selectively connects the high and low pressure sides of pump unit 2 to the opposite ends of the working cylinder 5. A pilot operated check valve unit 16 is secured in the opposite end of assembly 6 and is connected between the unit 14 and the one end line 11 of working cylinder 5 to alternately supply or drain oil thereform in accordance with the positioning of the valve unit 15. The booster pumping means 14 is located between units 15 and 16 and includes a high pressure outlet connected to the working cylinder unit and an inlet to the pump unit 2. A pressure relief valve unit 17 limits the maximum load pressure developed by the system. A unique control valve unit 18 located between the directional control valve unit 15 and the booster pumping unit 14 operates with unit 14 to cause high pressure pumping action. A sequence or on-off valve unit 19 is located in assembly 6 between the directional control valve unit 15 and the booster control valve unit 18. The sequence valve unit 19 is responsive to the working pressure of cylinder unit 1 to cause or permit the booster control valve unit 18 to operate and thereby develop an increased working pressure at the input or connecting line 11 to the working cylinder unit 1.

The several units 14–19 are mounted in coaxially spaced relation within assembly 6 which is constructed to facilitate the practical manufacture of the total assembly in compact, lightweight structure without the necessity of external connecting lines and without the necessity of expensive machined components.

Figure 3:
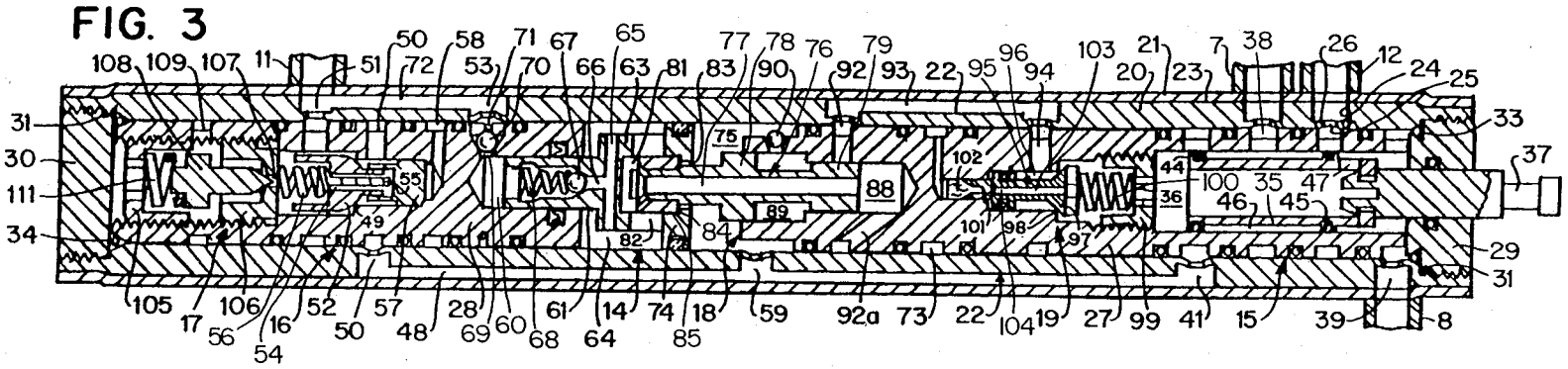
FIG. 3 is an enlarged vertical section through the valve unit shown in FIG. 1 and 2.

More particularly, in the illustrated embodiment as shown in FIG. 3, the assembly 6 includes a tubular housing 20 in which the several valves and booster pump units are contained in appropriate axially spaced and cascaded alignment. The housing 20 is fixed and sealed within an outer tubular shell 21. Grooves 22 in the outer wall or surface of the housing 20 provide interconnecting passageways between several ports of the assembly, as shown in detail in FIG. 4 and more fully developed hereinafter. Openings or ports are provided in the shell in alignment with the appropriate ports of the housing 20 for connection of the pump 2 and cylinder unit 1. This provides a very convenient and practical method of construction where high pressures on the order of 16,000 psi are encountered. The housing 20 and shell 21 may be furnaced brazed to form a brazed joint 23 or otherwise intimately joined. Brazing or otherwise intimate joining of the surfaces increases the pressure holding capability of the oil passages and eliminates any leakage between the passages. To facilitate the assembly, the ports are formed in the shell 21 by drilling or the like. Referring to the rightmost top port in FIG. 3, the aligned ports in the housing 20 are formed by drilling a partial port opening or recess 24 in the outer surface of the housing 20 and then punching a smaller port opening from the inside out. The port 25 is thus formed with an inwardly projecting bent lip 26 located within the die opening 24. This maintains housing 20 with a smooth or unobstructed inner and outer surface for assembly of shell 21 and the internal valve and operating components, as presently discussed.

In the illustrated embodiment, a pair of multiple valve bodies 27 and 28 are secured in axially spaced relation within the opposite ends of the housing 20 with internal passageways and components for forming the several valves and operating means. The valve bodies 27 and 28 are similar cylindrical members which closely fit within the ends of the housing 20 and are retained therein by end plugs 29 and 30 abutting the valve bodies 27 and 28 to define a fluid tight enclosure. The inventors have found that a particularly satisfactory threaded end is obtained by forming a threaded mandrel of suitably hardened steel and of a diameter slightly smaller than the end internal diameter of housing 20, and then swaging, crimping or otherwise working of the housing 20 and shell 21 onto the mandrel. The housing 20 is formed with an increased internal end diameter with an inner shoulder 31 against which the plug 29 abutts. An inner enlargement is aligned with the inner edge of the shoulder 31 and the surfaces shaped to define an annular chamber within which a seal 33 is located. The plug 30 abutts the valve body 28 with an O-ring seal 34 compressed in a recess formed in the end shoulder and valve body.

More particularly, the assembly 6 includes the directional control valve unit 15 having a directional control spool 35 slidably mounted within an end chamber 36 in the tubular valve body 27. The spool 35 is coupled to the control lever 13 through a mechanical connecting rod 37 for selectively positioning thereof. The valve body 27 has four ports which are axially spaced along the valve body 27 as shown in FIG. 1 and 3. The ports include supply port 38 connected to the pump unit 2, a port 39 connected to the pump reservoir 9, a reverse port 40 connected to the front side of the working cylinder 5 and to the pilot check valve 16 as hereinafter described and forward port 41 for supplying of the oil to the working cylinder 5 through the pilot operated check valve 16 or the booster unit 14. The ports are each similarly formed with a drilled radial opening and an exterior annular recess in the valve body 27 as shown at 38 to connect the internal valve recess chamber within which the spool 35 is located. The several ports of the directional valve unit 15, and of the other elements, are sealed from each other by the usual O-ring seals in suitable recesses in the outer surface of the valve bodies.

The input port 38 is located between the two outlet ports 40 and 41 for selective connection to the opposite ends of the working cylinder 5 by positioning of the spool 35 within the valve chamber 36. The spool 35 includes a pair of axially spaced piston rings 44 and 45 spaced essentially in accordance with the spacing of the two output ports 40 and 41 to form a coupling passageway 46 which selectively connects the several ports for supplying of oil to working cylinder unit 1 and booster assembly 6. The spool 35 is a tubular member having the inner end open to chamber 36 and the opposite end connected to rod 37.

The outer end of the spool 35 is provided with a laterally extending opening 47 that couples the axial spool opening and the one end of the chamber to the opposite end, establishing a reservoir connection to the reservoir port 39. In the position shown, the directional valve unit 15 is in neutral and the several ports 38 - 41 are connected to the reservoir 9. Shifting the spool 35 inwardly, shifts the spaced piston rings 44 and 45 between the ports with one ring closing the connection from the input port 38 to the front cylinder port 40 and connecting the input port to the rear cylinder port 41. The front cylinder port 40 is now connected directly to the reservoir port 9. Reverse positioning of the spool 35 to the opposite position within the valve chamber 36 closes the rear cylinder port 41 and connects the front cylinder port 40 to the inlet pump port 38. The rear cylinder port 11 is then connected to the reservoir port 39 through the center of the spool 35, suitable passages 47 and 48 and the pilot operated check valve 16.

In the working position for extending of the piston rod 3, the port 38 provides fluid flow through port 41 to and through the peripheral passageway 48 extending axially along the tube or housing 20 to the pilot operated check valve unit 16. Under low pressure conditions, check valve unit 16 is opened by the incoming low pressure and provides direct transfer of the high volume, low pressure oil through line 11 to the rear or back end of the cylinder 5 to affect a forward movement of the cylinder piston 4 and rod 3.

The pilot operated check valve unit 16 is formed in the second body portion 28. The valve body 28 has a coaxial recess within the outer end with the valve unit 16 formed within the inner end of such recess. The inner end is stepped to form a valve seat 49 between a transfer port 50 and an adjacent cylinder port 51 which, in turn, is connected to the line 11 to the rear end of the cylinder 5 and a port 53. The larger portion of the valve chamber is adjacent the cylinder port 51 and a valve member 52 is coaxially mounted within the chamber with a ball or rounded valve seat urged into sealing engagement with the fixed valve seat 49. A relatively small diameter stem portion is integrally formed with a ball shaped valve seat. The valve member 52 has a central stepped opening within which a poppet valve member 54 is located with a head biased to close the opening and a stem 55 projecting outwardly of the opening. A small coil spring 56 is located within the enlarged portion in engagement with the head 54 and urges or biases the valve members 52 and 54 into sealing engagement with their respective seals and thereby normally closing the passage from the transfer port 50 to the cylinder port 51. A pilot valve piston 57 is located between the transfer port 50 and a control port 58 within the innermost end of the valve unit 16. The piston 57 includes a tubular recessed end which projects axially over the stems of valve members 52 and 54. The signal port 58 is connected by a passageway 59*a* on the outer surface of the housing 20 to the reverse port 40 of the directional valve unit 15. With the spool valve unit 15 in the forward portion, port 40 is connected to the reservoir and thus essentially zero pressure is applied to the piston 57 of pilot valve unit 16.

Therefore, in this state, incoming pressurized oil at port 50 acts on the check valve members 52 and 54, compressing the spring 56, which moves the valve unit 16 to the open position and permits oil to flow to the working cylinder 5. This flow continues until the back or load pressure condition created within the working cylinder 5 is greater than the supply pressure. When the back pressure builds up, the oil flow decreases and a balanced pressure acts on the valve members 52 and 54. This allows spring 56 to close the check valve unit 16. Essentially, simultaneously, the back pressure actuates the sequence valve 19 and pressurized oil is allowed to flow through the control valve unit 18 and the booster pump unit 14.

The booster pump unit 14 is controlled and cycled by the interconnected control valve unit 18. The output of the directional valve unit 15 is connected to the units 14 and 16 by a port 59 connected to the passageway 48 from the port 41 of directional valve unit 15.

The booster unit 14 is formed at the innermost end of the second valve body 28 which, in the illustrated embodiment of the invention, terminates in housing 20, in spaced relation to the valve body 27. A high pressure pumping chamber 60, shown at approximately one-half of the diameter of the body portion 28, is found in the inner end of body portion 28. A high pressure small area piston 61 is located within the chamber and sealed by an encircling ring seal 62. Seal 62 may, for example, be a high pressure urathane seal located within a recess within the pumping chamber wall. The piston 61 includes an outer head 63 located within a transfer chamber 64 adjacent the end of the valve body and within outer housing 20. The diameter of the head 63 is smaller than the chamber diameter and includes a lateral opening 65 providing communication to the transfer chamber surrounding the head and an axial passage 66 in the piston. The passage 66 extends axially through piston 61 and is shaped to seat a spring-loaded check ball 67 which is secured within the piston by a spring 68 that urges the ball to close the axial passageway. The innermost end of the piston chamber is provided with a lateral outlet port 69 having a check ball 70 located within an enlarged outer portion thereof. The check ball 70 is secured within the enlarged opening by a small encircling spring member 71. A passage 72 extends through the housing 20 to port 51 from port 53 and thus to the line 11 and the high pressure end of the working cylinder 5.

Figure 4:
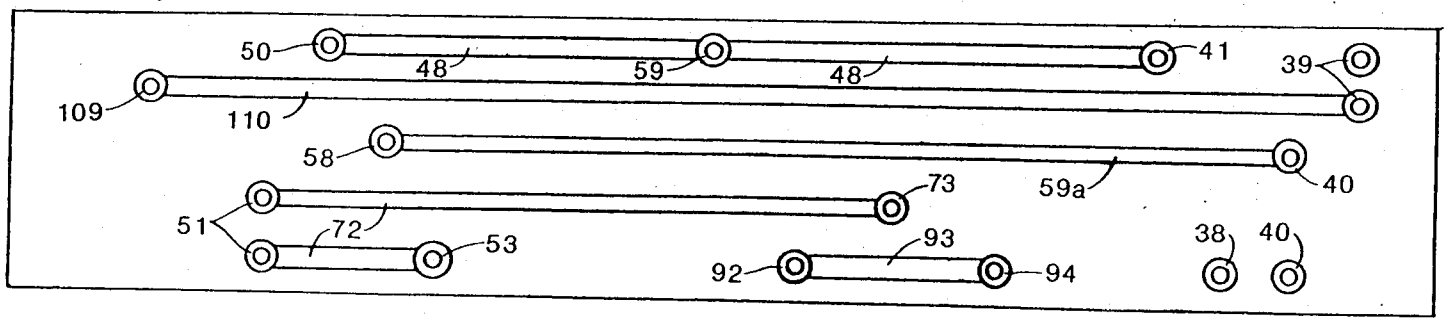
FIG. 4 is a developed view of the flow passages formed on the outer shell of the unit shown in FIGS. 1–8.
Figure 11:
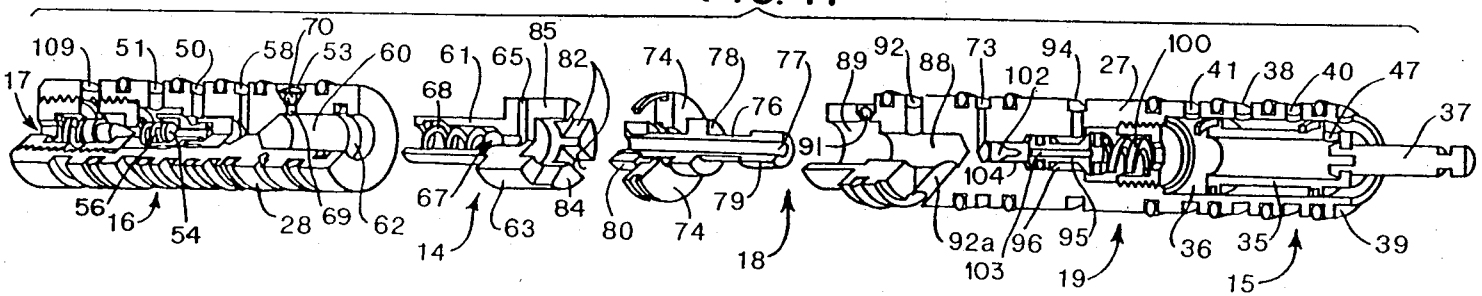
FIG. 11 has been exploded cut-away view to illustrate the parts.
Figure 9:
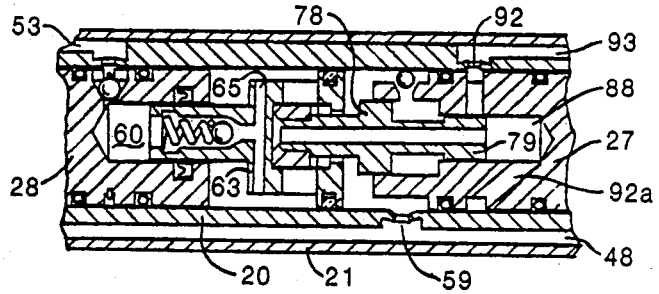

An axial passage 72 shown in FIGS. 4 and 9 also extends from port 51 and terminates in a connecting port 73 to the sequencing valve unit 19. Thus, the pressure in the working cylinder 5 is also applied to the sequence valve unit 19 which opens to complete an exhaust flow for the control valve unit 18, permitting full operation of the booster pumping means 14, as hereinafter described.

Referring again to the booster unit 14, the high pressure pumping chamber 60 is filled with oil through the control valve unit 18. A large area low pressure piston 74 is coupled to the head 63 and pump pressure is operative thereon. The inlet port or passage 59 is formed in housing 20 to control chamber 75 on the opposite side of piston 74 and is connected to the passage 48 from the directional control port 41. The piston 74 includes a high pressure sliding seal such as a piston ring engaging the inner wall of the housing 20 to define the separate distinct transfer and input chambers 64 and 75 to the opposite sides of the large area low pressure piston. The piston 74 is operative to force the high pressure piston 61 into the chamber 60 with high pressure oil forced out through the check valve 70 to the working cylinder 5.

This pressure is also applied to the pilot port 73 of the sequence valve unit 19 and to the pilot operated check valve 16. The latter is closed, however, as a result of the previous action and is, of course, held closed. The high pressure on the sequence valve unit 19 also holds it open to exhaust the control valve unit 18 and allow an automatic pumping action.

The control valve unit 18 is preferably and uniquely a spool type valve having a spool member 76 with central passageway or opening 77 and reciprocally mounted within the housing 20 between the piston head 63 and the control valve body 27. The spool member 76 has three axially spaced and interconnected spools 78, 79 and 80 of different diameters including a large diameter spool 78 located centrally of the spool member, between a small diameter spool 79 and an intermediate diameter spool 80 on the opposite ends of the spool member 76. Each spool 78, 79 and 80 functions as a part of a valve and as a piston to uniquely control the application of the oil pressure on the booster pistons 61 and 74 and on the spool member 76 to produce shifting of such elements.

The head 63 of the high pressure piston 61 is a cup-shaped member within which the intermediate diameter spool 80 of the control valve spool member 76 is located. The depth of the head recess 81 combined with the depth of the cross slot 82 is slightly greater than the length of the piston spool 80. The head 63 also includes a pair of cross-slots 82 at 90° to each other, which provides communication between the outer encircling transfer chamber 64 and the inner recess or chamber 81. The large area low pressure piston 74 is freely mounted, with a somewhat enlarged opening 83 slightly larger than spool 79 and smaller than spool 78 on the spool member 76 adjacent the piston 74.

The intermediate diameter spool 80 is located within head 63, for example, to form part of a control valve for supercharging of the booster chamber 60 and the small diameter spool 79 is located with valve body 27 to selectively connect the transfer chamber 64 to exhaust. Piston 74 is also recessed to define a hydraulic cylinder 85 terminating in a valve seat 84 for spool 80. The spool 80 is secured as a separate element to the end of the spool member such that communication or a flow path is maintained between the central spool passageway 77 and the recess and therefore the transfer chamber at appropriate times. With the spool 80 located within the head 63 an open valved passageway 83 permits oil to flow past the piston 74 into the transfer chamber 64 to the opposite side of the large area low pressure piston 74 and through check valve 67 and therefore into the pumping chamber 60.

The large diameter control spool 78 is integrally formed on the spool member 76 in spaced relation to the spool 80 within the booster input chamber 75 to the inlet side of piston 74. The opposite end of the spool member 76 includes the small spool 79 which is smaller than both the large diameter spool 78 and the intermediate diameter spool 80. The inner end of the valve body 27 is formed with a stepped recess defining chambers or bores 88 and 89 within which the large and small diameter spools reciprocate to control the booster action.

The innermost end of the valve body 27 includes the axial chamber or bore 88 within which the spool 79 is slidably mounted with a relatively close fit.

The outer end of the recess is enlarged to form a chamber or bore 89 having the diameter of the large spool 78 of the spool member 76. The length of the respective portions of the bores 88 and 89 and the spools 78 and 79 provide successive interaction with respect to the flow of the pump oil from chamber 75 and chamber 64 to the sequence valve unit 19. The innermost end of the body 27 has a reduced outer diameter and extends inwardly into the chamber 75 which is connected to input port 59. A check valve ball 90 closes a recirculating passageway 91 from the enlarged bore 89 to chamber 75.

The spool chamber 88 is connected to the sequence valve unit 19 by a trigger port 92 located intermediate the length of the chamber 88. A by-pass passageway **92*a* in body 27 connects the end of chamber 88 to the trigger port 92. An axial passageway 93 connects port 92 to a port 94 of the sequence valve 19 for exhausting of oil discharged from the pump unit 14 and valve unit 18. A pilot actuated check valve including a valve member 95 is slidably mounted within a chamber 96 formed as an extension of the directional control valve chamber 36 in body 27. The valve member 95 includes a cone-shaped head 97 defining a valve seat member adapted to seat on an edge sealing seat 98 between the small and enlarged portions and thus sealing of the exhaust port 94. The outer end of the sequence chamber 96 is closed by a suitable apertured adjusting screw 99 with a coil spring 100 located between the screw 99 and the valve head 97** to establish a predetermined bias holding the valve closed.

The inner end of valve member 95 is formed as a piston 101. The feed back pressure from the cylinder unit 5 is applied to the innermost end of the chamber and the backside of a pilot piston 102 through the port 73 which is connected by the passageway 72 to the cylinder port 51. The small pilot piston 102 is located within a reduced extension of the valve chamber. The pilot piston 102 is moved outwardly by the pressure in the port 73 against valve member 95 and at a selected level is effective to overcome the pressure of spring 100 and open sequence valve unit 19. With the sequence valve open, communication is provided from the control valve unit 18 and particularly trigger hole 92 to the exhaust chamber permitting exhaust from the control valve unit 18 and particularly the retraction of the control valve unit 18 for filling of the high pressure chamber 60. The valve member 95 has an axial opening 103 and a cross opening 104 in the inner face of piston 101 to exhaust oil which may leak into the inner portion of the chamber 96. This oil would otherwise be trapped and prevent the complete closure of head 97 on seal 98 when the output pressure drops.

In summary, the three spool valve member 76 with different diameter spools, each of which is used as a valve and as a piston, hydraulically shifts and controls the direction of travel of the booster piston unit formed by pistons 61 and 74.

Figure 6:
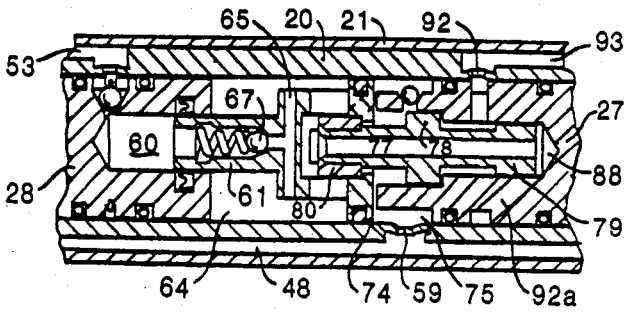
FIGS. 6–10 are similar enlarged views of a booster forming a part of the unit shown in FIGS. 2–4 and illustrating the position of the several elements in a cycle of the booster.
Figure 7:
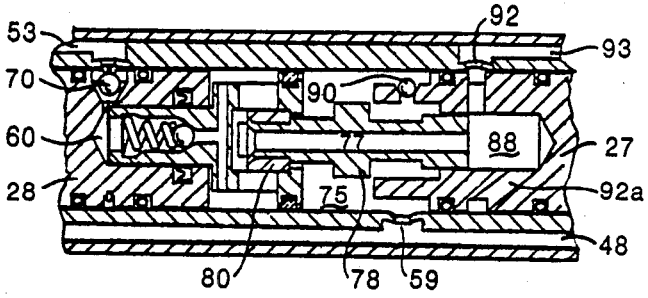
Figure 8:
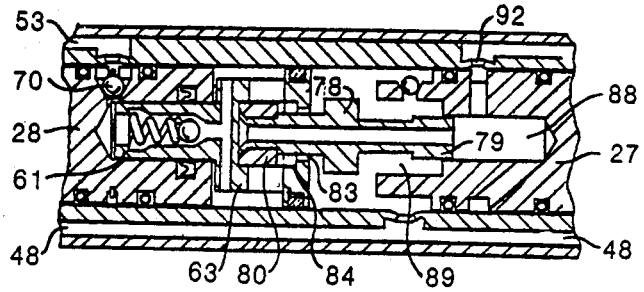

At the beginning of a pumping or boost stroke, as shown in FIG. 6, the intermediate diameter spool 80 is against the seat in the large area low pressure piston 74 and thus closes the path of the oil from chamber 75 through the piston 74. The spool 80 is held firmly against the seat by the oil pressure acting against the large diameter central spool's exposed area. Oil pressure is trying to unseat the intermediate diameter spool 80 but does not do so because of the greater opposing force exerted as a result of the greater area of the central spool 78. The oil opposite the pressure side of the large area low pressure piston 74 is exposed to the reservoir 9 via the head opening 82 exposed to the front of the intermediate diameter spool 80 and the axial hole or passageway 77 passing completely through the three spool member 76, the passageways 92a 92, 93 and 94 to the opened sequence valve unit 19. The oil in the high pressure pumping chamber 60 is connected to the outlet port and line 11 for the high pressure oil via the passage 69 containing a spring loaded check valve 70. Oil is prevented from returning to the low pressure area by the check valve 67 in passage 66 of the small area high pressure booster piston 61. The smaller diameter spool 79 is in a neutralized condition having both sides exposed to reservoir pressure by port 92 and passageway 92a. Incoming oil acts against the large area low pressure piston 74 and forces it through its bore, shown moving to the left in FIG. 7. The oil in the high pressure chamber 60 is driven out of the chamber at a correspindingly high pressure. The oil opposite the pressure side of the large area low pressure piston 74 in chamber 64 is discharged to the reservoir through the previously described passageway. The pistons 61 and 74 reach the end of the pumping stroke, as shown in FIG. 7, and spool 78 of the member 76 is withdrawn from its bore 89. The small diameter spool 79 has closed the exhaust port 92 and sealed the chamber 75 and 89 from the sequence valve unit 19 and reservoir 9. The incoming oil moves into the void in chamber 89 created as the large central spool 78 was being withdrawn from its bore 89 and places input pressure to the right side of spool 78. This action neutralizes the shifting force of the large central spool 78. The incoming oil pressure now acts upon the wcposed area of the small diameter spool 79 and the exposed area of the intermediate diameter spool 80. The exposed area of the latter is larger and the intermediate diameter spool member acts as a piston to shift the three diameter spool member 76 towards the intermediate diameter spool end. The exhaust opening or passageway 77 is closed as the intermediate diameter spool 80 enters the cylinder or recess 81 in the head 63 of the small area high pressure piston 61. As the shift continues, the intermediate diameter spool 80 leaves the bore 85 and valve seat 84 in the large area low pressure piston 74. This opens the connecting passage 83 and connects both sides of the large area low pressure piston 74 to the same oil pressure. This essentially completes the spool member shift and the intermediate diameter spool 80 is forced into head 63 as far as it can move, as shown in FIG. 8. At this point all piston means of the booster unit 14 and the control unit 18 are neutralized with the exception of the small diameter spool 79 and the intermediate spool 80. The oil pressure now acts upon the entire or effective total cross sectional area of the small diameter spool 79 and reverses the movement of the assembly as shown in FIG. 9. This is accomplished as oil flows from chamber 75, passage 83, chamber 64, passage 65 and 66 through the axial check valve 67 of the small area high pressure booster piston 61 into chamber 60. As the oil enters the high pressure chamber 60, it exerts pressure on the small area high pressure piston surface. The recessed area 81 in the head 63 of piston 61 is exposed to the reservoir pressure via the axial hole 77 through the three spool member 76 and not the input pressure. This develops a differential pressure that returns the assembly as the high pressure booster pumping chamber 60 refills for the next pumping stroke. The filling of the high pressure chamber 60 in this manner minimizes cavitation of the high pressure booster pumping chamber such as is often encountered in various intensifiers.

Figure 10:
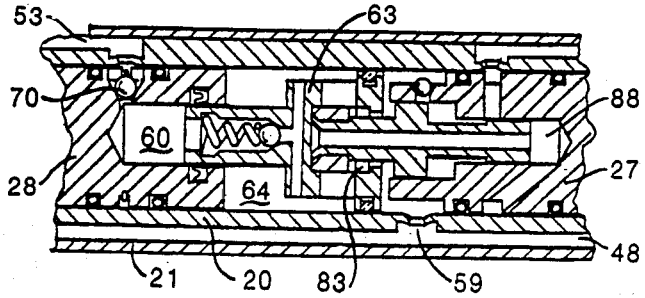

As the pistons return, as shown in FIG. 9, the large diameter spool 78 re-enters its bore 89 and displaces oil out through the check valve opening 91. This recirculates the oil back into the system and increases the system efficiency. As the pistons reach the end of the stroke, as shown in FIG. 10, the small diameter spool 79 passes the trigger port 92 and connects the chambers 88 and 89 between the large central spool 78 and the small diameter spool 79 to the sequence valve unit 19 and thus to reservoir 9. This allows oil to drain out of chamber 89 and reduces the pressure on the right side of the large diameter spool 78. Incoming oil from chamber 75 is prevented from flowing directly to the reservoir by the closing of the check valve 90 in the lateral port 91 as the direction of flow reverses. The resulting unbalance of pressure on the large central spool 78 causes the three diameter spool member 76 to shift toward the small diameter spool end. This action moves the intermediate diameter spool 80 from the position of FIG. 10 within the head 63 to a position within the bore 85 in piston 74 to close the opening 83 passing through the large area low pressure piston 74 and open the passage which connects the chamber 64 to axial opening 77 in member 76 and thus to the sequence valve unit 19 and reservoir 9. This completes the entire pumping cycle as the intermediate diameter spool 80 is forced against the seat in the large low pressure booster piston and the assembly begins another pumping stroke, as shown in FIG. 6.

In the preferred embodiment the return line or passageway to the reservoir 9 is through the pilot operated sequence valve unit 19. Until the sequence valve unit 19 is opened, the booster section will not operate. The pilot port 73 is connected to the high pressure outlet passageway 72 of the booster section 14 to maintain the signal pressure necessary to hold the valve open. If the signal were connected, for example, to the supply line port the drop in pressure occurring as the booster section begins to operate would close the sequence valve unit and excessive pumping pressures would be required. If the flow of oil is blocked at the input port 59 supplying oil to chamber 75 or at the outlet port 53 from the high pressure chamber 60 the booster section similarly will not operate. The connection to the exhaust side simplifies the pressure connections.

To limit the overall working pressure, a high pressure release valve unit 17 is connected to the system between the high pressure port 51 at the pilot operated check valve unit 16 and the reservoir 9. Valve unit 17 includes a cup-shaped valve body 106 threaded into the outer end of the recessed portion of the valve body 28. An opening 107 in the body 106 is closed by a spring-loaded valve needle 108 that is mounted within the valve body 106 with an adjustable nut 105 for setting the pressure of the spring. An exhaust port 109 in the body 28 is connected by a housing passageway 110 terminating in a lateral port at the directional valve chamber to the reservoir port 39 and reservoir line 8. Thus, if an abnormal or undesired pressure is created, the back pressure will be reflected to the pilot operated valve chamber of unit 16 and onto the needle valve 108. The pressure moves the needle 108, overcoming the bias of the loading spring 111 and provides a direct path of the high pressure oil and thereby prevents the creation of abnormal pressures.

If the directional valve unit 15 is moved to the reverse position, the pump input port 38 is now coupled to the front cylinder port 40 and the rear cylinder port 41 is connected to the reservoir through the axial opening in the spool 35. Pump pressure is now applied to the front side of the working cylinder 1 causing retraction of the internal piston 4. Pump pressure is also applied to the pilot piston 57 via port 40 and passage 59*a* and port 58 opening the pilot operated check valve unit 16 and allowing oil to return back through port 51 and into port 50 and then via passage 48 to the rear port 41 of the directional valve unit 16 and then through the direction valve passageway 36 in the spool 35 to the reservoir 9. This provides for a retraction of the working cylinder rod 3.

With directional valve unit 16 set in neutral, the pump port 38 is connected directly to both the front and rear ports 40 and 41 to provide a balanced condition and eliminating all residual pressure, as shown in FIG. 3. In the neutral position the working cylinder unit 1 is locked in the previously set position. Pressure is also removed from the pilot check valve unit 16 and the valve closes thereby preventing flow from the working cylinder 1.

The present invention does not require the construction of unusually high quality parts. Generally conventional machine tooled parts in combination with very conventioal and readily available pressure seals and the like can be employed. The various details of the booster pumping section can, of course, be varied employing the basic concept of the interrelated functional control of the automatic reciprocative hydraulic cylinder control valve and piston arrangement. The directional valve unit, pilot operated check valve unit, high pressure relief unit and the like can, of course, be replaced with any suitable control or completely eliminated if the particular functions are not required or desired. The components can also be duplicated if more than one unit is required to fulfill a specific application's requirements.

The arrangement of ports and interconnecting passages in the outer housing 20 may be altered to fulfill the flow requirements of various arrangement of individual hydraulic elements that may be selected to fulfill a given hydraulic circuit's function. Thus, this aspect of the invention may be employed in other hydraulic systems. For example, the double walled housing may include the constructio of a double acting hydraulic cylinder having both ports located at the same end. The connection of the displaced port is accomplished via a port through the outer housing connected to a groove on the inner member and terminating in a port through the inner member. By proper application of this technique a telescopic double acting hydraulic cylinder may be constructed having both ports located at the base of the cylinder.

Various modes of carrying out the invention are contemplated as being within the scope of the following claims particularly pointing out and distinctly claiming the subject matter which is regarded as the invention.

We claim:

1. A hydraulic booster power apparatus including a power amplifying pump unit having a differential area pumping element movable within a pump chamber unit between first and second positions, said pumping element having opposite sides in said chamber unit, said chamber unit having an inlet means adapted to be connected to receive fluid and an exhaust means for discharging fluid, a control means having an operating means coupled to said differential area pumping element to form a first valve means for selective connection of the chamber unit to the opposite sides of the pumping element and movable therewith, said operating means controlling a plurality of additional valve means in response to movement with the pumping element to control the movement of the operating means and thereby opening and closing of said first valve means to supply fluid to opposite sides of the differential area pumping element and to exhaust fluid from the opposite sides of said differential area pumping element.

2. The apparatus of claim 1 wherein said operating means includes a spool member having a plurality of axially spaced spools including a first spool coupled to the pumping element and a second larger spool larger than said first spool and a third smaller spool smaller than said first spool, and a valve body located with said second and third spools movable in corresponding second and third bores therein, said second spool having the supply pressure applied to one side and selectively applied to the opposite side thereof within said second bore and said third spool selectively connecting the second spool and said exhaust means to exhaust fluid from the second bore and from said chamber unit.

3. The apparatus of claim 2 wherein said first valve means includes a large area low pressure piston mounted on said spool member between said first and second spools, said piston having a valve bore defining a seat for said first spool, said spool member having a central opening connecting to said third bore of said third spool.

4. The apparatus of claim 3 wherein said piston is a free floating piston having an opening larger than said spool member and having a head portion with a recess accommodating said first spool, said head portion having cross-slots located in said recess and connected to said central opening.

5. In the apparatus of claim 2 wherein said pumping element includes a large area low pressure piston mounted as a free floating piston secured on said operating means between said first spool and said second spool, said pumping element including a small area low pressure piston having a head smaller than said floating piston and abutting the floating piston, said floating piston having an edge seal slidably engaging said pump chamber to separate and define a transfer chamber and an input chamber to the opposite sides of said floating piston, a lateral passageway means in said head establishing communication from the transfer chamber to said first valved means and to the input chamber, and a pumping input port connected to the input chamber.

* * * * *